US006244549B1

(12) United States Patent
Ching

(10) Patent No.: US 6,244,549 B1
(45) Date of Patent: Jun. 12, 2001

(54) FITTING ADAPTED FOR HOLDING SPACEDLY A SUPPORT MEMBER ON AN UPRIGHT WALL

(76) Inventor: Wen-Chan Ching, No. 47, Lane 142, Tzu-Chiang I Rd., Chien-Chin Dist., Kaohsiung City (TW)

( * ) Notice: Subject to any disclaimer, the term of this patent is extended or adjusted under 35 U.S.C. 154(b) by 0 days.

(21) Appl. No.: 09/249,015

(22) Filed: Feb. 12, 1999

(51) Int. Cl.[7] ..... A47B 96/06

(52) U.S. Cl. ..... 248/222.14; 211/105.1; 248/251

(58) Field of Search ..... 248/311.2, 313, 248/314, 315, 316, 309.1, 222.14, 224.7, 251, 261, 262, 223.31, 224.8, 231.9, 201; 211/105.1

(56) References Cited

U.S. PATENT DOCUMENTS 4,979,713 * 12/1990 Bell ..... 248/224.3
5,026,013 * 6/1991 Robbins ..... 248/223.1
5,076,523 * 12/1991 Wang ..... 248/222.1
5,664,751 * 9/1997 Lan ..... 248/251
5,678,703 * 10/1997 Sawyer ..... 211/105.1
5,875,903 * 3/1999 Chen ..... 211/105.1
6,012,692 * 1/2000 Meck ..... 248/251
6,113,045 * 9/2000 Kuo ..... 248/222.14

* cited by examiner

*Primary Examiner*—Anita M. King
*Assistant Examiner*—Tan Le
(74) *Attorney, Agent, or Firm*—Dykema Gossett PLLC

(57) ABSTRACT

A fitting includes a stem extending in an axial direction and having a threaded surface adapted to be screwed into an upright wall. An annular head portion is connected to the stem, and has an abutting surface wall proximate to the stem and extending in a transverse direction relative to the axial direction for abutting against the upright wall when the stem is fixed in the upright wall. A cylindrical anchored member extends from the head portion in the axial direction away from the stem, and has a distal end distal to the abutting surface wall. A holding member includes an anchoring portion which is elongated in the axial direction to be sleeved on and to cover the anchored member, and a holding portion which is formed integrally with the anchoring portion for holding a support member. A fastening member is disposed to fix the anchoring portion relative to the anchored member by tightening along a radial direction relative to the axial direction.

6 Claims, 11 Drawing Sheets

FITTING ADAPTED FOR HOLDING SPACEDLY A SUPPORT MEMBER ON AN UPRIGHT WALL

BACKGROUND OF THE INVENTION

1. Field of the Invention

This invention relates to a fitting, more particularly to a fitting adapted for holding spacedly a support member, such as a transverse rod, a sheet plate, or a holding ring, on an upright wall.

2. Description of the Related Art

Referring to FIG. 1, a conventional fitting 1 is shown to include a positioning plate 10 with two holes 100 for passage of two screw fasteners 13 to fix on an upright wall 2 (see FIG. 2), and a cover 11 which has a major surface wall 115 with a rectangular central hole 110 and three protrusions 111 disposed thereon, and a surrounding wall 116 that extends from a periphery of the major surface wall 115 and that has a through hole 113. The positioning plate 10 engages the cover 11 among the protrusions 111. One of the protrusions 111 has a screw hole 112 to align with the through hole 113 such that a screw fastener 114 can pass through the through hole 113 and the screw hole 112 to anchor on the positioning plate 10 and fasten the cover 11 on the latter. A holding member 12 has a protrusion 120 at a proximate end thereof to be inserted into the central hole 110. The protrusion 120 has a screw hole 121 such that a screw fastener 122 is inserted into the screw hole 121 so as to fasten the holding member 12 on the major surface wall 115 of the cover 11. The holding member 12 has a holding portion in the form of ring 123 for holding a support member of a disk 23.

In assembly, the two screw fasteners 13 are first inserted threadedly into two screw fixtures 22 in two predetermined holes 21 in the upright wall 2 so as to fasten the positioning plate 10 on the wall 2. Then, the support member 12 is secured on the cover 11 by the screw fastener 122. Finally, the cover 11 is fastener on the positioning plate 10 by the screw fastener 114.

Referring to FIG. 3, another conventional fitting 3 is shown to differ from the above fitting 1 in that the holding portion 32 is in the form of an elongated shaft which extends transverse to the upright wall 2. An elongated retaining groove 320 is formed in and extends along the shaft. As such, when two fittings 3 are mounted on the upright wall 2, two side edges of a support member in the form of a sheet plate 33 can be held within the retaining grooves 320.

The conventional fittings 1,2 require many screw fasteners during assembly, thereby resulting in inconvenience. Moreover, as shown in FIG. 3, since there is a relatively large clearance 20 formed between the sheet plate 33 and the upright wall 2 due to the surrounding wall of the cover 31, there is a tendency for the objects placed on the sheet plate 33 to fall therefrom.

SUMMARY OF THE INVENTION

The object of the present invention is to provide a fitting which is can be conveniently assembled on an upright wall.

According to this invention, a fitting includes a stem extending in an axial direction and having a threaded surface adapted to be screwed into an upright wall. An annular head portion is connected to the stem, and has an abutting surface wall proximate to the stem and extending in a transverse direction relative to the axial direction for abutting against the upright wall when the stem is fixed in the upright wall. A cylindrical anchored member extends from the head portion in the axial direction away from the stem, and has a distal end distal to the abutting surface wall. A holding member includes an anchoring portion which is elongated in the axial direction to be sleeved on and to cover the anchored member, and a holding portion which is formed integrally with the anchoring portion for holding a support member. A fastening member is disposed to fix the anchoring portion relative to the anchored member by tightening along a radial direction relative to the axial direction. Thus, the fitting is fastener on the upright wall only by screwing the stem into the upright wall, thereby facilitating assembly of the fitting.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
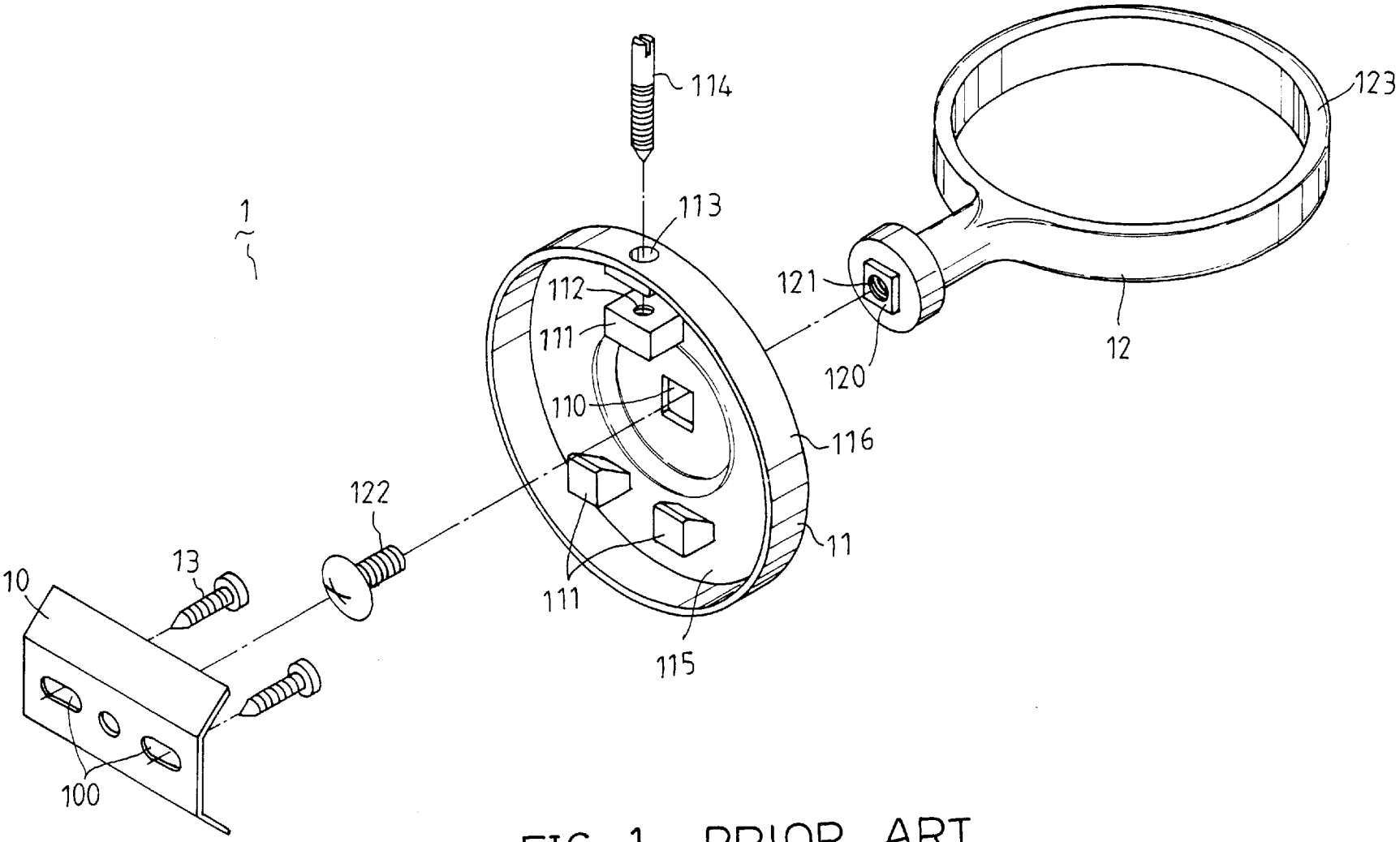
FIG. 1 PRIOR ART
FIG. 1 is an exploded perspective view of a conventional fitting.
Figure 2:
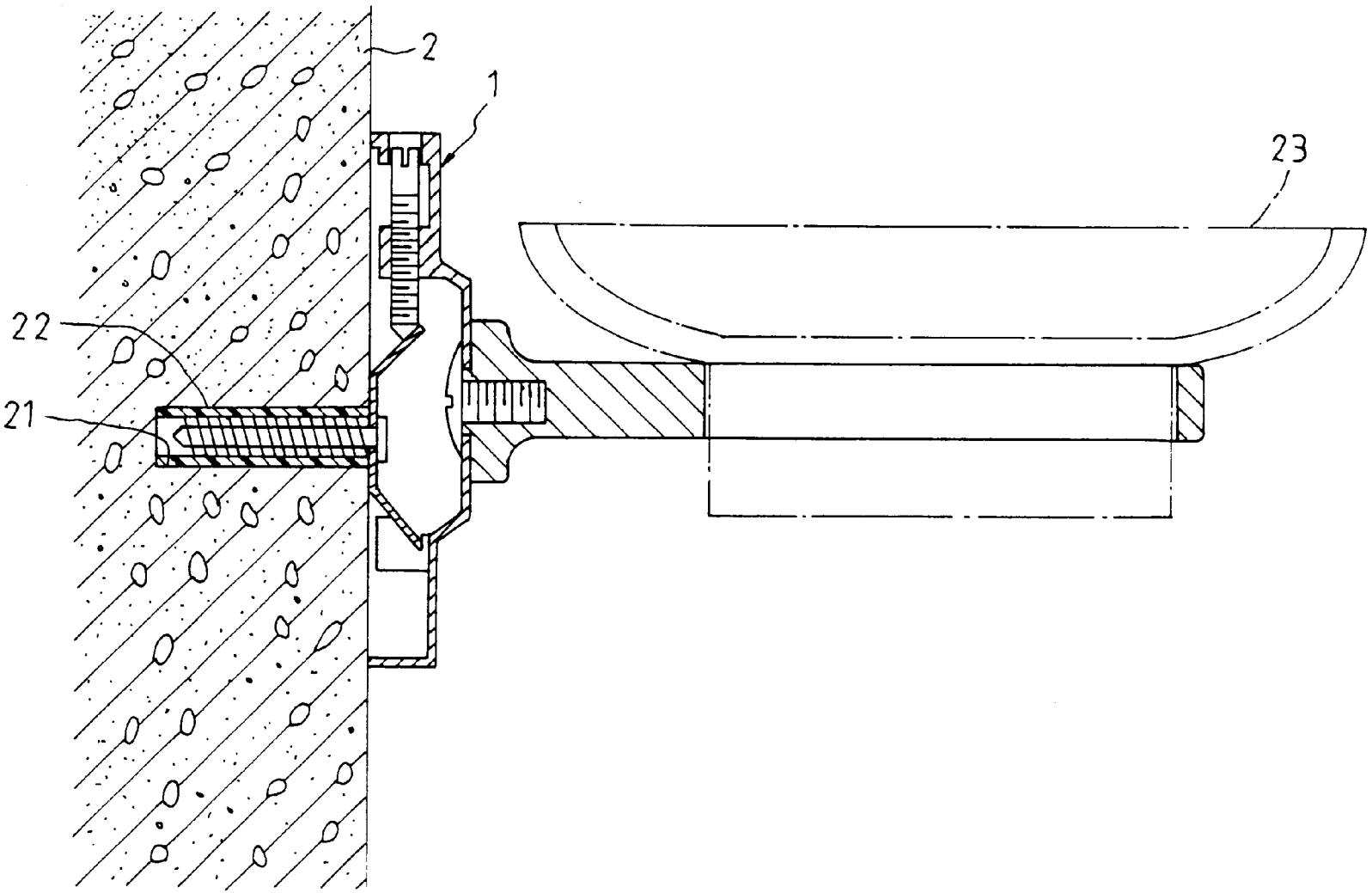
FIG. 2 PRIOR ART
FIG. 2 is a sectional side view showing the conventional fitting mounted on an upright wall.
Figure 3:
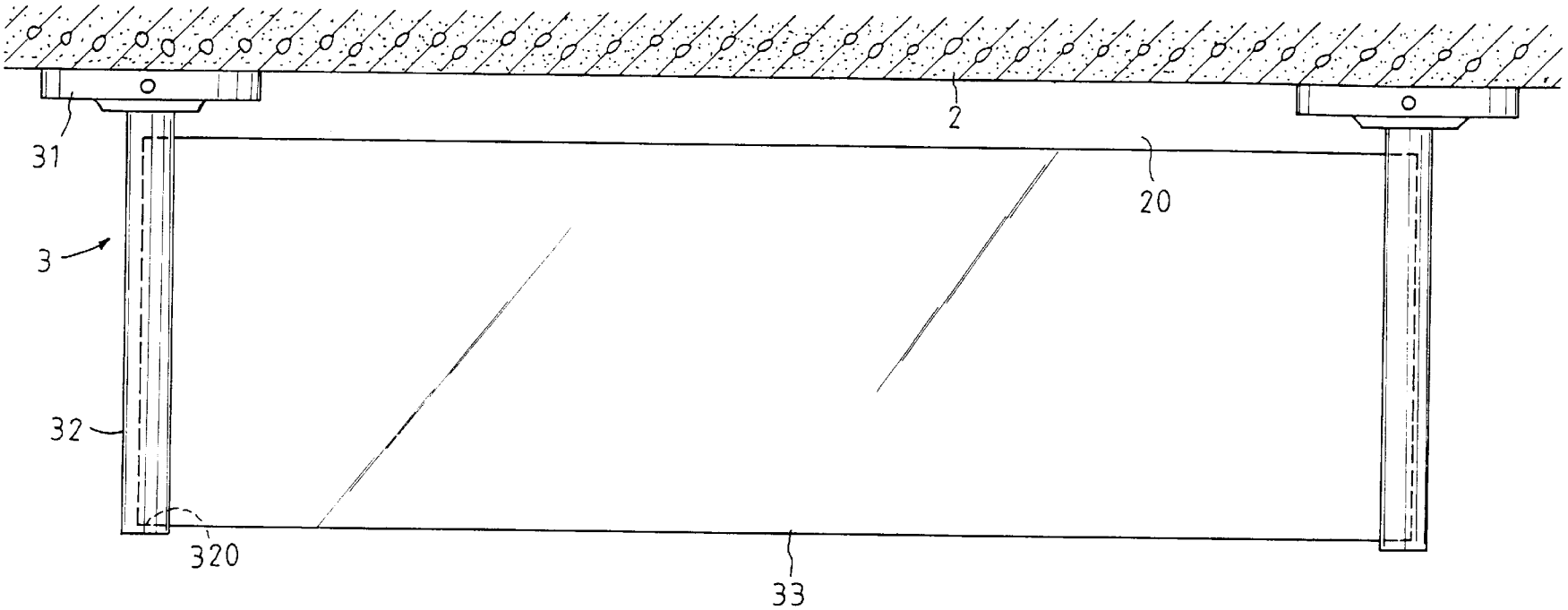
FIG. 3 PRIOR ART
FIG. 3 is a top plan view showing another conventional fitting mounted on an upright wall.

Before the present invention is described in greater detail, it should be noted that same reference numerals have been used to denote like elements throughout the specification.

Figure 4:
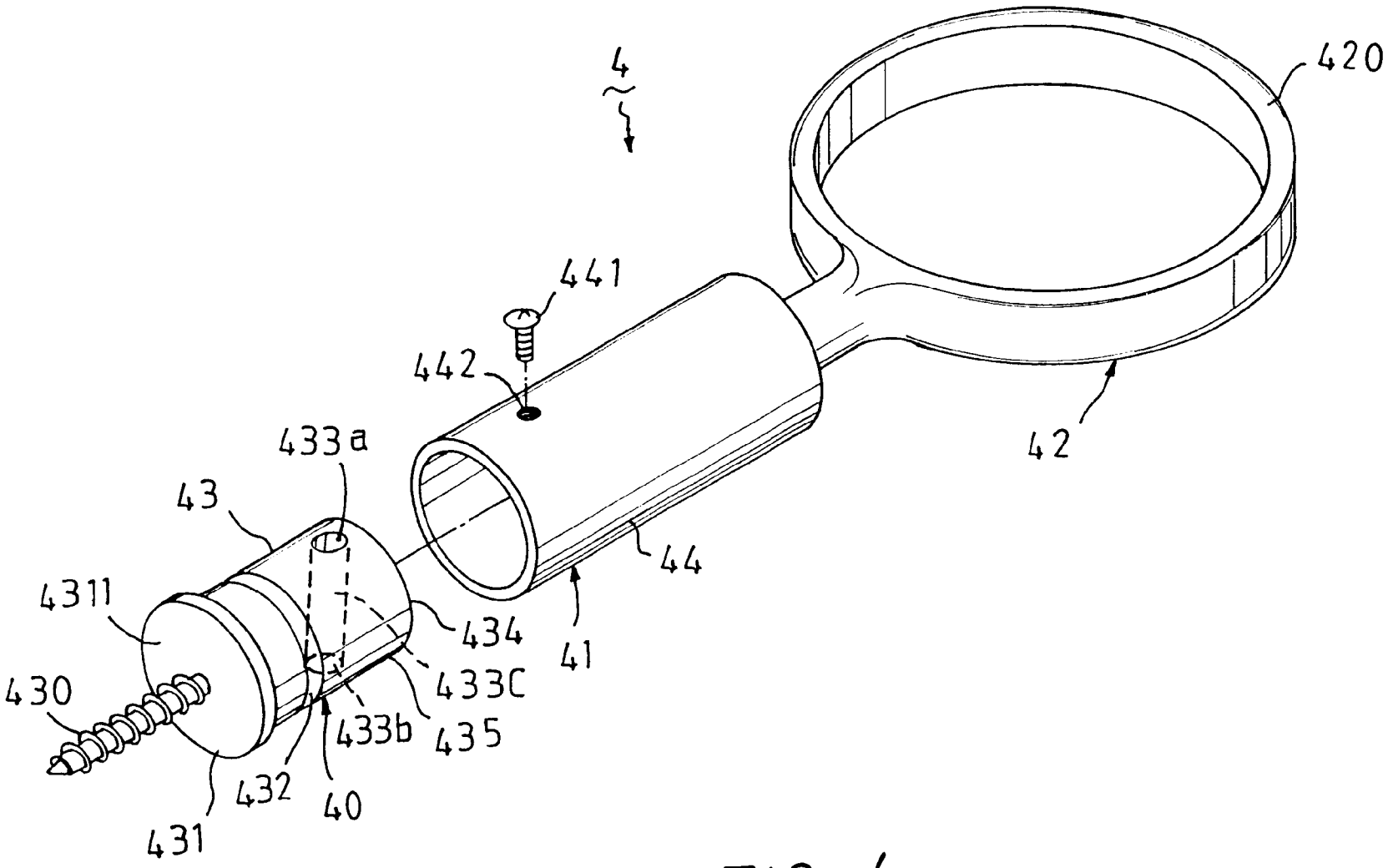
FIG. 4 is an exploded perspective view of a first preferred embodiment of a fitting according to this invention.
Figure 5:
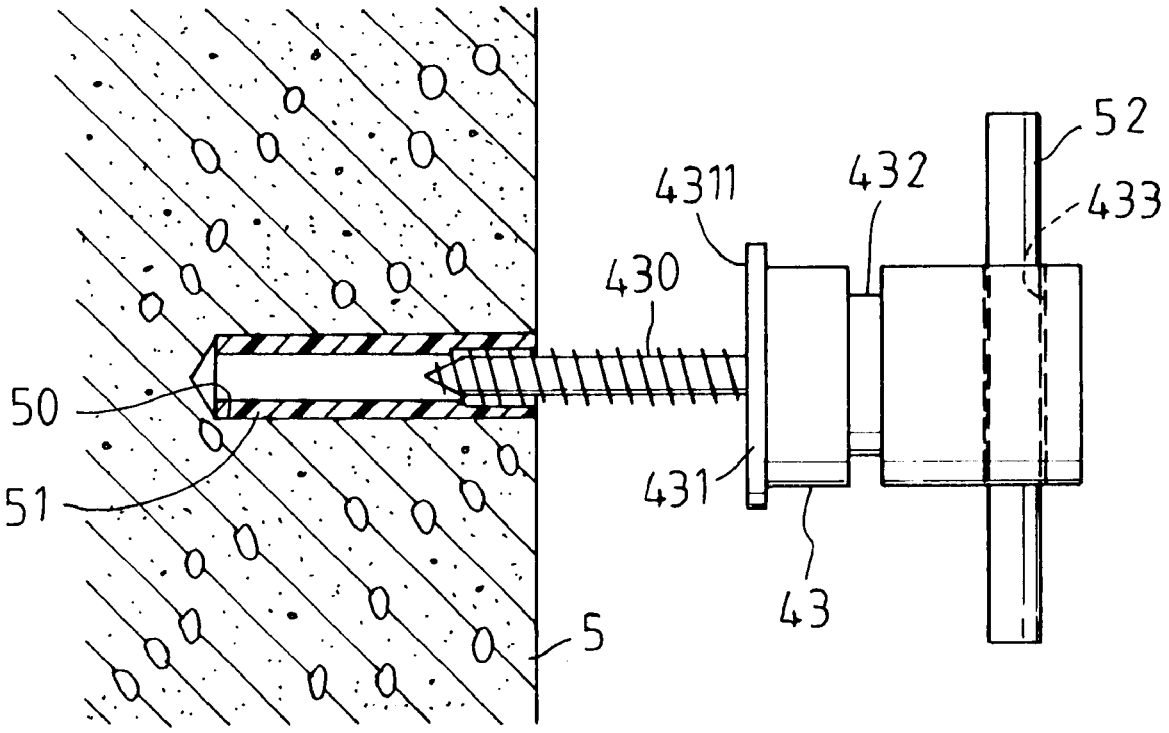
FIG. 5 is a side view showing how the first preferred embodiment is fixed on an upright wall.
Figure 6:
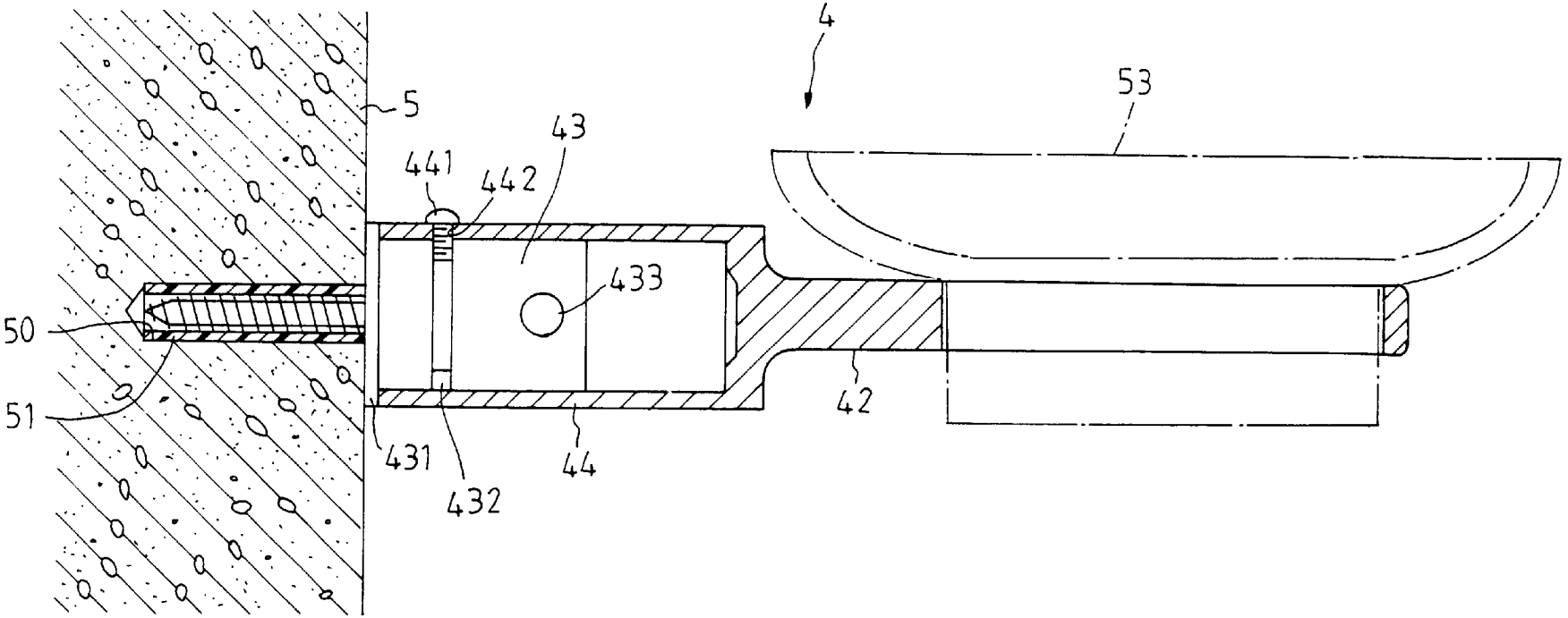
FIG. 6 is a sectional view showing the first preferred embodiment fixed on the upright wall.

Referring to FIGS. 4, 5 and 6, the first preferred embodiment of the fitting 4 according to the present invention is shown to include a screw member 40 and a holding member 41.

The screw member 40 includes a stem 430, a surrounding head portion 431, and a cylindrical anchored member 43. The stem 430 extends in an axial direction, and has a threaded surface formed thereon. The head portion 431 is connected to the stem 430, and has an abutting surface wall 4311 proximate to the stem 430 and extending in a transverse direction relative to the axial direction. The anchored member 43 extends from the head portion 431 in the axial direction away from the stem 430, and has a distal end 434 distal to the abutting surface wall 4311, and an intermediate circumferential wall 435 which is interposed between the head portion 431 and the distal end 434. Two insert holes 433*a* and 433*b* are diametrically disposed in the intermediate circumferential wall 435 and are proximate to the distal end 434. These insert holes can communicate by way of bore 433*c*.

The holding member 41 includes a hollow anchoring portion 44 which is elongated in the axial direction to be sleeved on and to cover the anchored member 43, and a holding portion 42 which is formed integrally with and which extends in the axial direction from the anchoring portion 44. In this preferred embodiment, the holding portion 42 has a ring 420 which confines a holding area that extends in the axial direction for holding a disk 53 of a support member.

A fastening member includes an annular groove 432 which is formed in the intermediate circumferential wall 435 and proximate to the head portion 431, a screw hole 442 which is formed in the anchoring portion 44 at a position aligned with the annular groove 432 when the anchoring portion 44 is sleeved on and covers the anchored member 43 and which extends in a radial direction relative to the axial direction, and a screw fastener 441 which is inserted threadedly into the screw hole 442 and the annular groove 432 so as to fix the anchoring portion 44 relative to the anchored member 43 along the radial direction.

In assembly, referring to FIG. 5, a screw fixture 51 is inserted into a pre-formed hole 50 in an upright wall 5, and the stem 430 is screwed into the screw fixture 51 by inserting a torque tool 52 through the through holes 433*a*, 433*b* and bore 433*c* to rotate the anchored member 43 until the abutting surface wall 4311 abuts against the upright wall 5.

Figure 7:
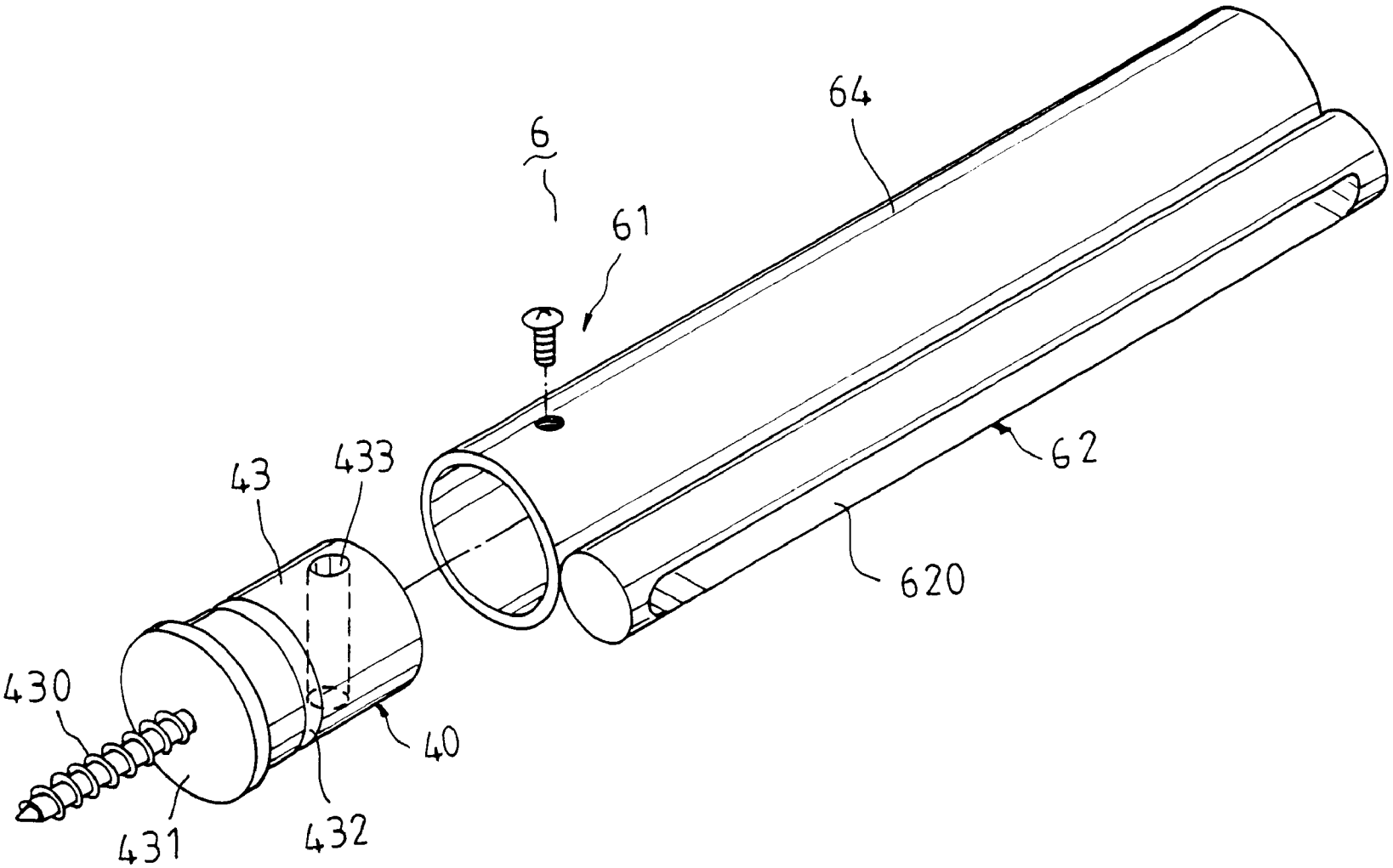
FIG. 7 is an exploded perspective view of a second preferred embodiment of a fitting according to this invention.
Figure 8:
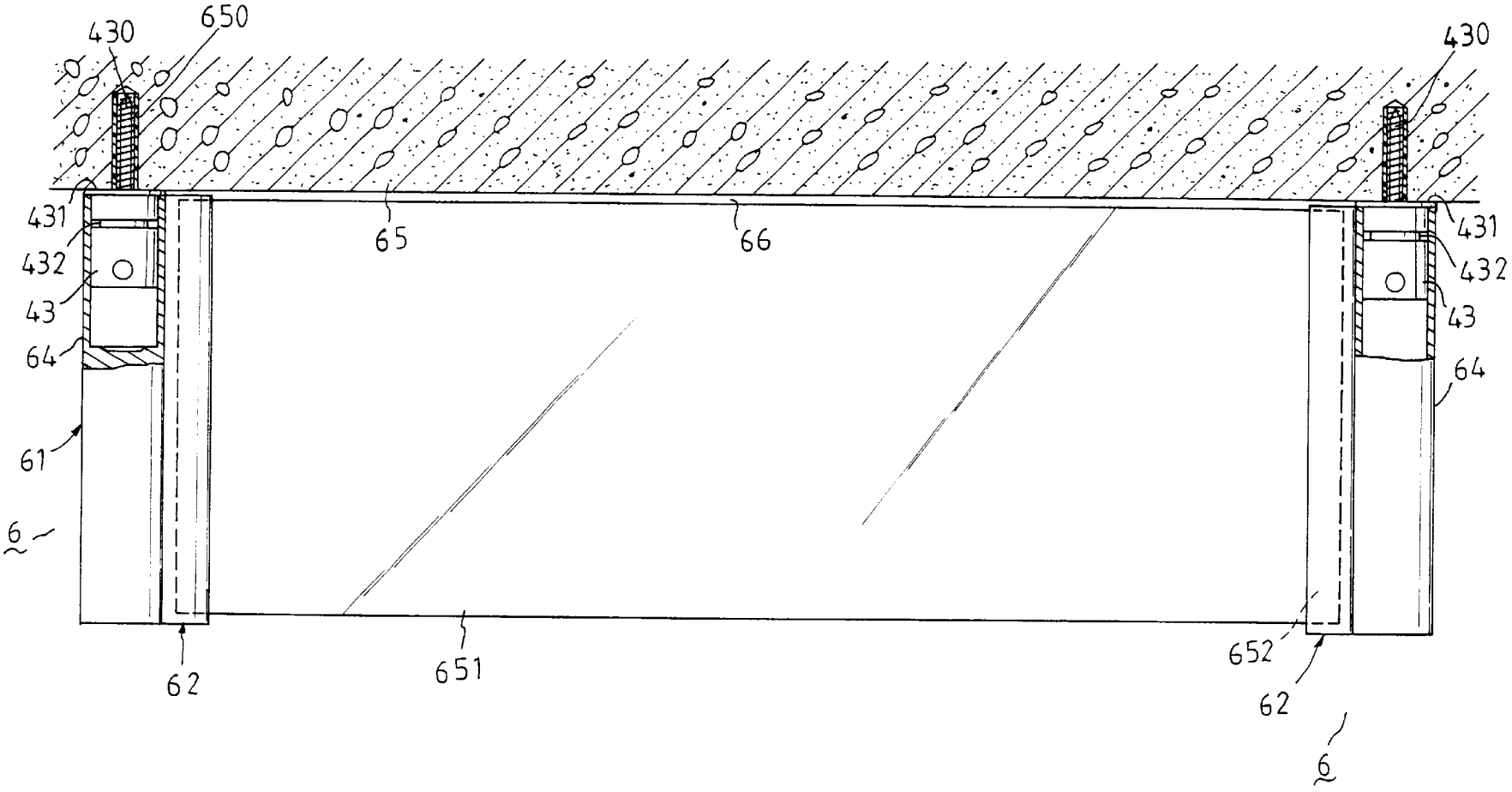
FIG. 8 is a sectional view showing the second preferred embodiment fixed on an upright wall.

Referring to FIG. 7, the second preferred embodiment of the fitting 6 according to this invention is shown to have a basic construction that is generally the same as the first preferred embodiment, and is different therefrom in that the holding portion 62 of the holding member 61 has an elongated retaining member which is juxtaposed laterally with the anchoring portion 64 and which extends parallel to the axial direction, and an elongated retaining groove 620 which is formed in and which extends along the elongated retaining member and distal to the anchoring portion 64. With reference to FIG. 8, when two fittings 6 of this embodiment are mounted on an upright wall 65 in such a manner that the stems 430 of the fittings 6 are inserted respectively into the screw fixtures 650, two side edges 652 of a plate sheet 651 of a support member can be held within the retaining grooves 620. In this embodiment, the clearance 66 between the upright wall 65 and the plate sheet 651 is substantially reduced, thereby preventing objects placed on the sheet 651 from falling from the clearance 66.

Figure 9:
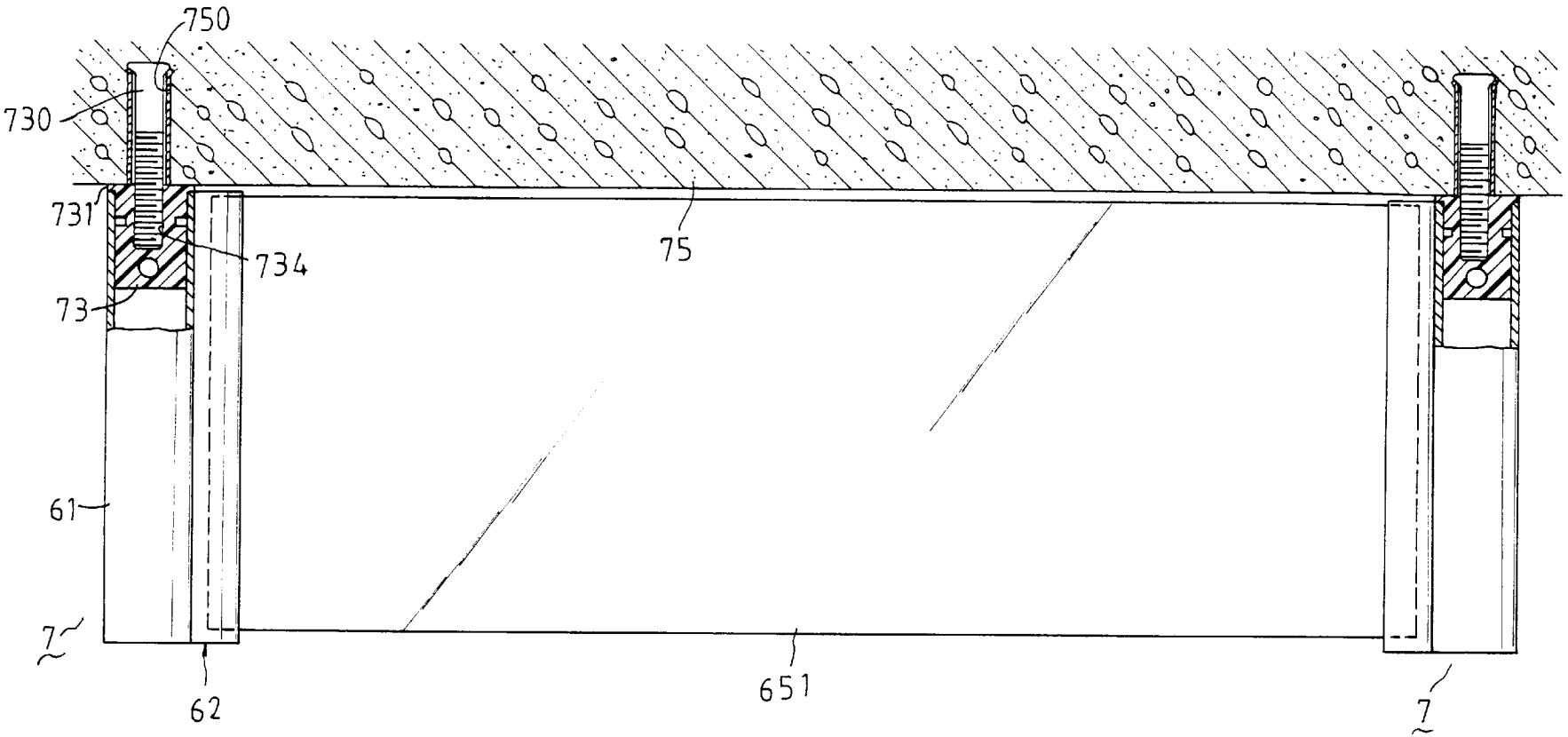
FIG. 9 is a sectional top plan view showing the fitting of the third preferred embodiment fixed on an upright wall.

Referring to FIG. 9, the third preferred embodiment of the fitting 7 according to this invention is shown to have a basic construction that is generally the same as the second preferred embodiment, and is different therefrom in that the stem 730 is in the form of an expansion bolt, and a threaded hole 734 is formed in the head portion 731 and the anchored member 73 and extends in the axial direction. As such, in assembly, one end of the expansion bolt is first inserted into a pre-formed hole 750 of the upright wall 75 to be anchored securely therein, and the other end thereof is disposed out of the upright wall 75. Then, the anchored member 73 is rotated about the axial direction to engage threadedly the stem 730 in such a manner that the other end of the stem 730 is screwed into the threaded hole 734.

Figure 10:
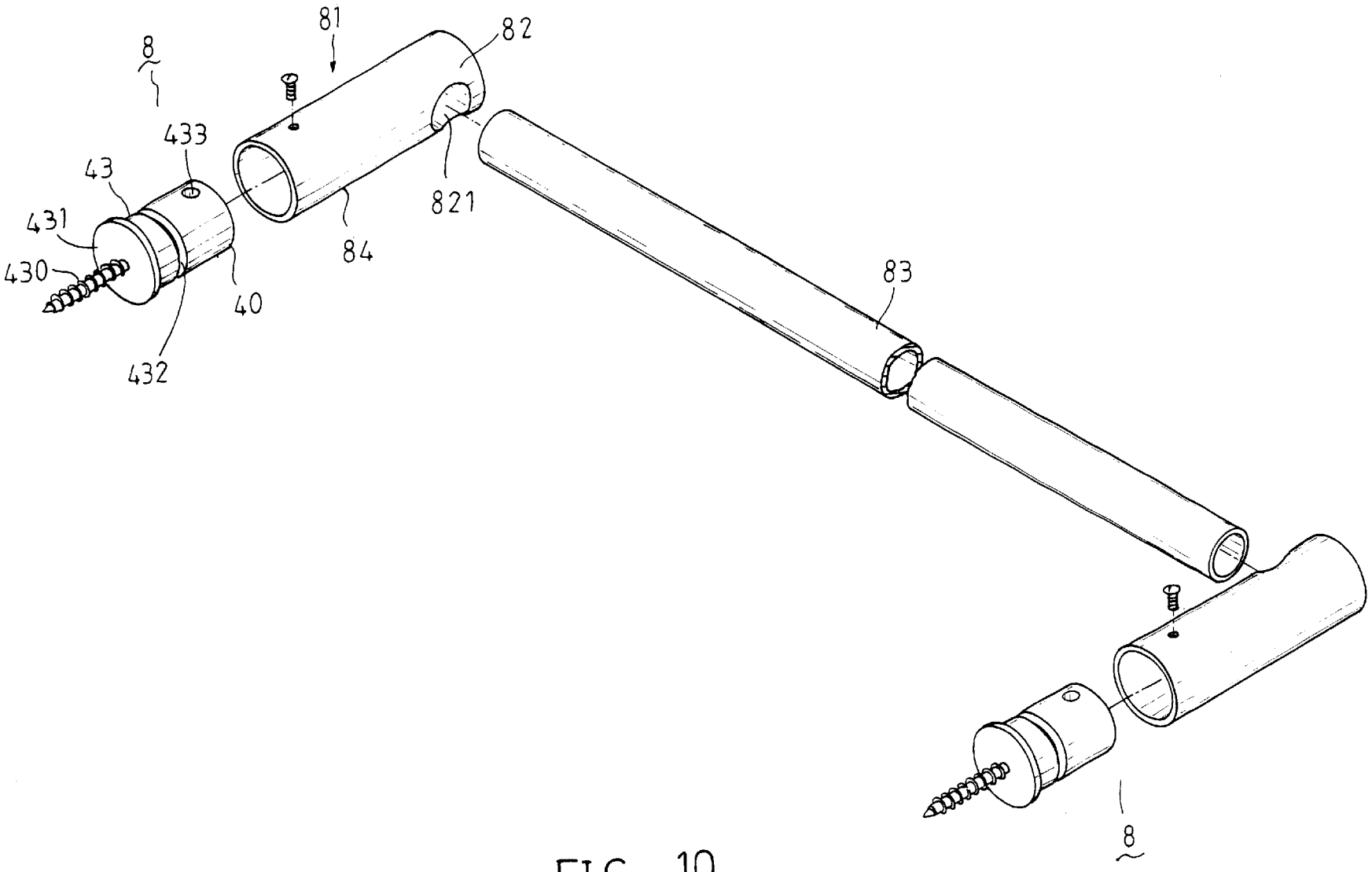
FIG. 10 is an exploded perspective view of a fourth preferred embodiment of a fitting according to this invention.
Figure 11:
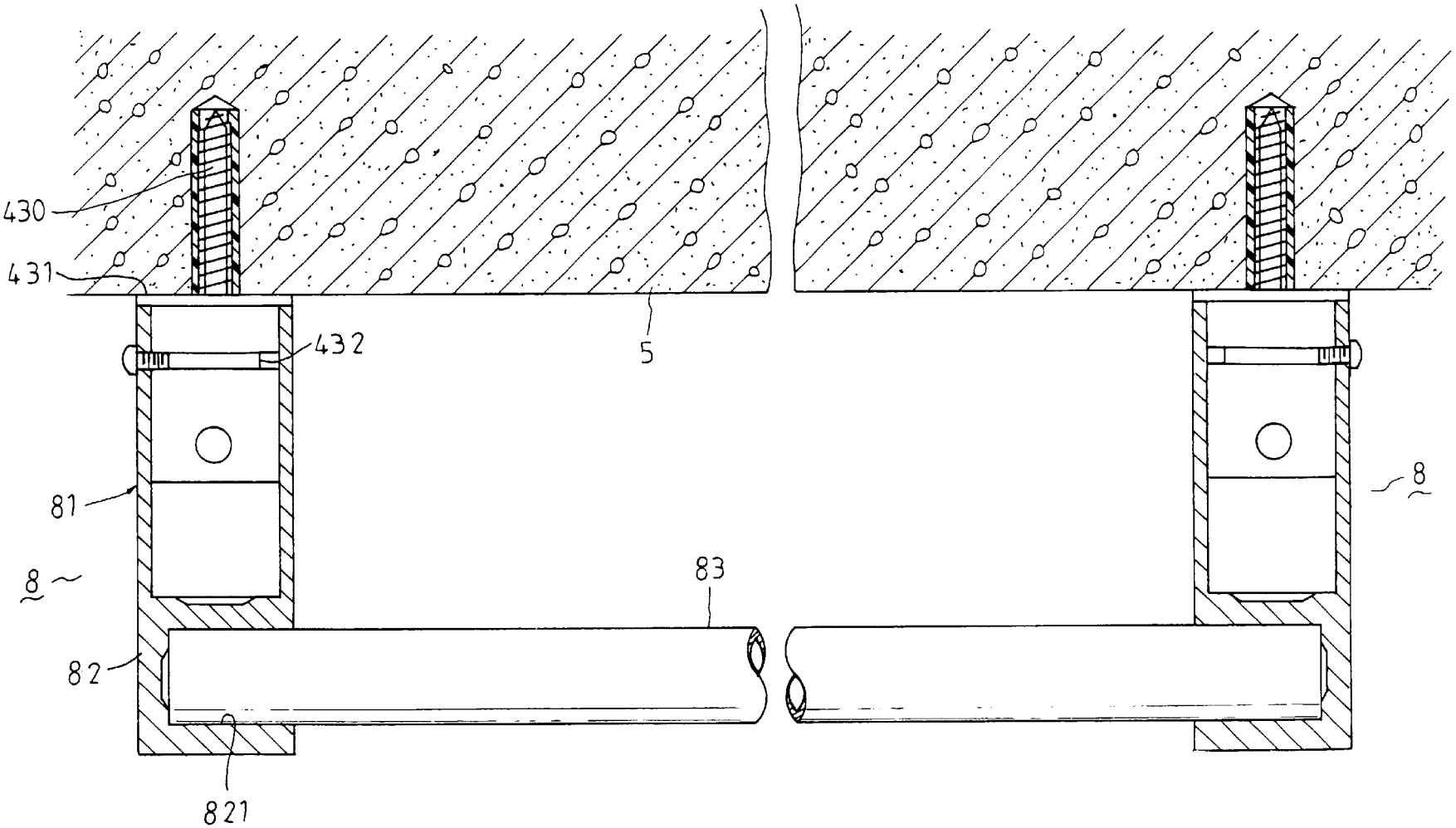
FIG. 11 a sectional top plan view showing the fourth preferred embodiment fixed on an upright wall.

Referring to FIGS. 10 and 11, the fourth preferred embodiment of the fitting 8 according to this invention is shown to have a basic construction that is generally the same as the first preferred embodiment, and is different therefrom in that the holding member 81 is tubular and of a single construction so as to confine the anchoring portion 84 at an end proximate to the anchored portion 43 and to confine the holding portion 82 at an opposite end. The holding portion 82 has a holding hole 821 which is formed therethrough and which extends in the radial direction. Thus, when the stems 430 of two fittings 8 of this embodiment are screwed into the upright wall 5, two ends of a support member in the form of a transverse rod 83 can be held within the holding holes 821 such that washcloths or the like can be hung on the transverse rod 83.

As mentioned above, the fitting according to this invention is fixed on an upright wall only by screwing the stem 430 into the upright wall, thereby resulting in convenience during assembly. In addition, as shown in FIGS. 8 and 9, the support member in the form of a sheet plate 651 can be held as close as possible to the upright wall 65 so as to prevent small objects placed thereon from falling therefrom.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A fitting for holding a support member on an upright wall, comprising:

a stem extending in an axial direction and having a threaded surface to be screwed into the upright wall;

a surrounding head portion connected to said stem and having an abutting surface wall proximate to said stem, said abutting surface wall extending in a transverse direction relative to said axial direction for abutting the upright wall when said stem is fixed in the upright wall;

a cylindrical anchored member extending from said head portion in said axial direction away from said stem and having a distal end distal to said abutting surface wall, said anchored member including an intermediate circumferential wall interposed between said head portion and said distal end which includes two insert holes diametrically disposed therein proximate to said distal end for insertion of a torque tool to rotate said anchored member so as to drive said stem into the upright wall;

a holding member including an anchoring portion which is elongated in said axial direction and which has a dimension such that said anchoring portion is sleeved on and covers said anchored member, and a holding portion which is formed integrally with said anchoring portion and which is adapted to hold the support member; and a fastening member including an annular groove formed in said intermediate circumferential wall and proximate to said head portion, a screw hole formed in said anchoring portion at a positioned aligned with said annular groove when said anchoring portion is sleeved on and covers said anchored member, and extending in a radial direction relative to said axial direction, and a screw fastener inserted threadedly into said screw hole and said annular groove when said screw hole is aligned with said annular groove so as to fix said anchoring portion relative to said anchored member by tightening along the radial direction.

2. The fitting as claimed in claim 1, wherein said holding portion of said holding member extends in said axial direction from said anchoring portion distal to said screw hole.

3. The fitting as claimed in claim 2, wherein said holding portion has a holding area extending in said axial direction and adapted to hold the support member.

4. The fitting as claimed in claim 2, wherein said holding portion has a holding hole formed therethrough and extending in said radial direction so as to be adapted to be journalled by the support member.

5. The fitting as claimed in claim 1, wherein said holding portion of said holding member has an elongated retaining member juxtaposed laterally with said anchoring portion and extending parallel to said axial direction, and an elongated retaining groove formed in and extending along said retaining member and distal to said anchoring portion so as to be adapted to receive a side edge of the support member which is in a form of a sheet.

6. The fitting as claimed in claim 1, wherein said insert holes are connected by a bore.

* * * * *